United States Patent [19]

Fleischer

[11] Patent Number: 4,539,897

[45] Date of Patent: Sep. 10, 1985

[54] DUCT SYSTEM FOR A TRACK-GUIDED VEHICLE

[75] Inventor: Horst Fleischer, Weinstadt, Fed. Rep. of Germany

[73] Assignee: Daimler-Benz Aktiengesellschaft, Fed. Rep. of Germany

[21] Appl. No.: 595,475

[22] Filed: Mar. 30, 1984

[51] Int. Cl.[3] ..... F23J 11/00

[52] U.S. Cl. ..... 98/49; 98/115.4

[58] Field of Search ..... 98/49, 115 VM; 110/162, 110/184; 285/185, 226

[56] References Cited

U.S. PATENT DOCUMENTS

| | | | |
|---|---|---|---|
| 320,875 | 6/1885 | Hunter | 110/184 |
| 719,483 | 2/1903 | Mansfield | 285/226 X |
| 1,094,323 | 4/1914 | Fulton | 285/226 X |
| 1,904,357 | 4/1933 | Coppus | 110/184 |
| 2,695,630 | 11/1954 | Klein et al. | 138/46.5 |
| 3,064,549 | 11/1962 | Newton | 98/115 VM X |
| 3,826,523 | 7/1974 | Eschbaugh | 285/39 |
| 3,913,470 | 10/1975 | Cullen | 98/115 VM |
| 4,086,847 | 5/1978 | Overmyer | 98/115 VM |
| 4,233,889 | 11/1980 | Nederman | 98/115 VM |

FOREIGN PATENT DOCUMENTS

| | | |
|---|---|---|
| 632868 | 8/1968 | Fed. Rep. of Germany . |
| 2726651 | 12/1978 | Fed. Rep. of Germany . |
| 2838990 | 3/1980 | Fed. Rep. of Germany . |
| 870112 | 6/1961 | United Kingdom . |

*Primary Examiner*—Harold Joyce

*Attorney, Agent, or Firm*—Barnes & Thornburg

[57] ABSTRACT

An exhaust duct system for a track-guided vehicle powered by an internal combustion engine having a fixed section extending through the interior of the vehicle and a section projecting above the roof of the vehicle for channeling exhaust gases into a force-vented exhaust channel. Transverse movements of the vehicle, with respect to the exhaust channel, are allowed for by providing for lateral movement of the transfer pipe on the roof-side section of the exhaust duct system. A connecting element forms a transition between the transfer pipe and the pipe ends of the fixed exhaust duct section. This connecting element is sealed with respect to the surroundings and is movable about a longitudinally extending pivot axis. The connecting element can be a pleated metal bellows or two pipe shells arranged concentrically to each other and to the pivot axis.

1 Claim, 5 Drawing Figures

8
11
12
10
9
1
7
6
5
4
2
2
3
3

DUCT SYSTEM FOR A TRACK-GUIDED VEHICLE

BACKGROUND AND SUMMARY OF THE INVENTION

This invention relates generally to an exhaust gas duct system for a track-guided vehicle powered by an internal combustion engine and, in particular, to a duct system which extends a short distance above the vehicle roof and into a force-vented exhaust channel arranged alongside the vehicle driving route. A known system is shown in German Published Application DOS No. 3,225,344.

Tunnel routes traveled by track-guided vehicles powered by internal combustion engines can be kept free of gaseous combustion products by a force-vented exhaust channel into which the exhaust gases are introduced. In DOS No. 3,225,344, the disposal of exhaust gases takes place via a fixed part of an exhaust conduit which extends to and terminates at the vehicle roof. A protective pipe surrounds the fixed part of the conduit and conducts air from the engine space which mixes with the exhaust gas in a subsequent, laterally movable part of the exhaust conduit. An open collecting funnel through which ambient air is also taken in covers the ends of the exhaust conduit and of the protective pipe, without being connected to either. The funnel connects to a double-walled transfer pipe having a boat-like cross section which projects between sealing lips into the exhaust channel. Because of the injector effect, exhaust gas is transported into the exhaust channel in spite of the open transition element. The laterally movable part of the exhaust ducting system is mounted by means of fastening stems to the vehicle roof. These stems have hinged joints which form a pivot axis. Righting springs bias the transfer pipe toward a vertical position. A disadvantage of this arrangement is that during startup, or at certain other times, there exists the danger of blowing exhaust gases directly into the interior of the tunnel.

An object of this invention is to provide a system for conducting exhaust gases, as well as air from the engine air space, to an exhaust channel under all operating conditions without restricting the lateral movability of the transfer pipe.

This and other objects are attained in an exhaust duct system which extends from the engine and engine air space vertically to a point above the vehicle roof and into a force-vented exhaust channel located adjacent to the driving route. The duct system comprises an exhaust conduit, a protective pipe surrounding the conduit and terminating a short distance above the vehicle roof, a transfer pipe with a boat-shaped cross-section extending into the exhaust channel, and a gas-tight connecting element for connecting the exhaust conduit and protective pipe to the transfer pipe. The connecting member is pivotable about an axis which extends substantially parallel to a longitudinal axis of the vehicle. In one embodiment, the connecting element comprises an elastic, pleated metal bellows which acts to bias the transfer pipe toward a vertical position. In another embodiment, the connecting element comprises a lower pipe shell attached to the vehicle and the protective pipe and an upper pipe shell attached to the transfer pipe. The upper and lower shells are arranged concentrically around a pivot axis and are sealed at their end faces. A spring is provided in this embodiment for biasing the transfer pipe toward a vertical position.

Further objects, features, and advantages of the present invention will become more apparent from the following description when taken with the accompanying drawings which show, for purposes of illustration only, several embodiments in accordance with the present invention.

DETAILED DESCRIPTION OF THE DRAWING

Figure 1:
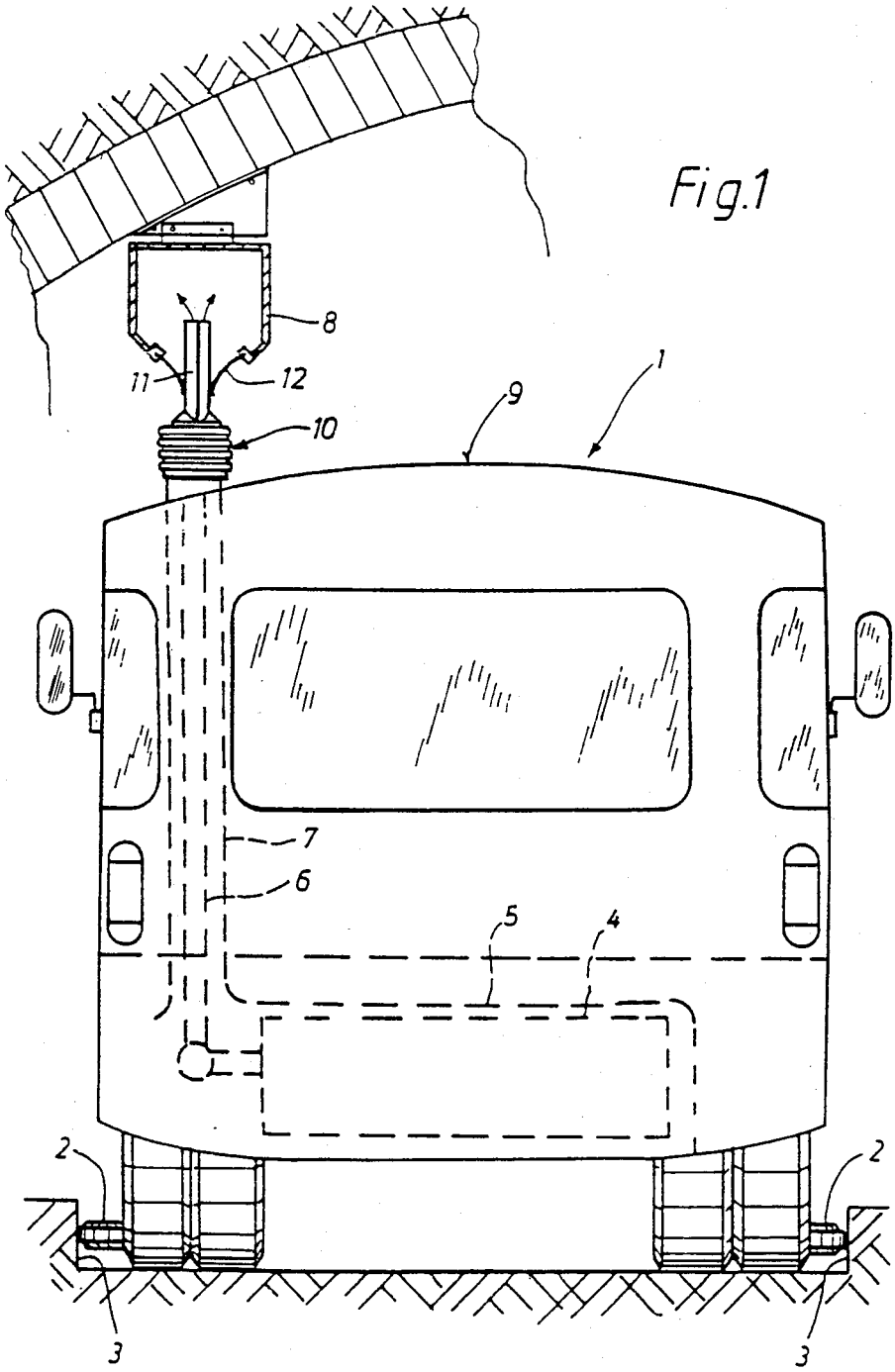
FIG. 1 shows a vehicle equipped with an exhaust duct system, according to the present invention, having a pleated metal bellows as the connecting element.
Figure 2:
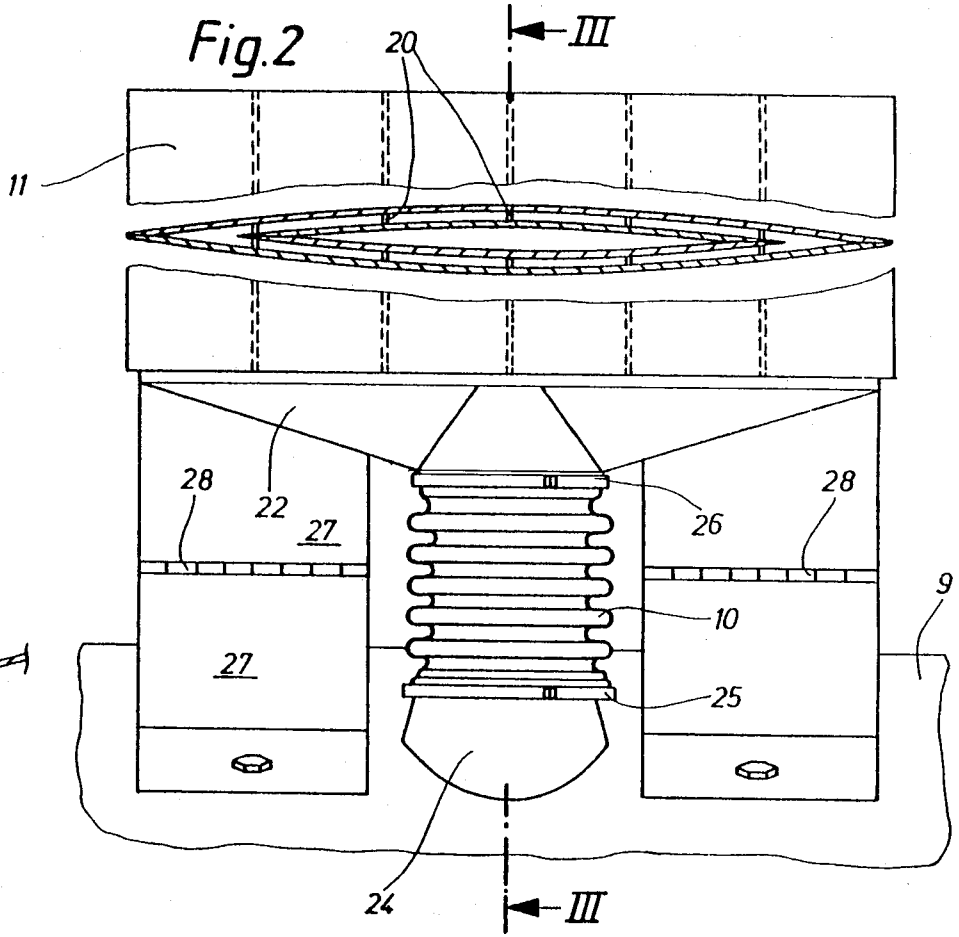
FIG. 2 shows an enlarged lateral view of a section of the exhaust duct system of FIG. 1.

Vehicle 1, illustrated in FIG. 1, is track-guided mechanically by means of transverse guide rollers 2 along guide lanes 3. The vehicle is driven by internal combustion engine 4 located in engine space 5. Exhaust conduit 6 and surrounding heat-insulating protective pipe 7 (through which air from engine space 5 is taken in) lead through the interior of the vehicle and terminate a short distance above roof 9 of vehicle 1. A connecting element, comprising pleated metal bellows 10, connects exhaust conduit 6 and protective pipe 7 with transfer pipe 11. Pipe 11 has a horizontal cross section which is boat-shaped, as shown in FIG. 2 between the break lines. Suspended from the tunnel ceiling is force-vented exhaust channel 8, which has on its underside facing vehicle 1, a longitudinal slot closed by a pair of elastic sealing lips 12. Lips 12 are spread apart by transfer pipe 11 and are, in this arrangement, in sealing contact with the outside of transfer pipe 11.

Exhaust conduit 6 and protective pipe 7 are fixedly attached to vehicle 1. Protective pipe 7 carries a flow of air from engine space 5 and thus serves especially to insulate exhaust conduit 6, which is filled with hot exhaust gases, from that part of the vehicle interior through which it extends. Additionally, the flow of air through protective pipe 7 ventilates engine space 5, and dilutes and cools the exhaust gases as the two flows mix upon exiting above the vehicle roof. Intensive mixing of exhaust gases and engine space air (which is drawn into protective pipe 7 by injection and chimney effects) takes place in the connecting element before the gases enter transfer pipe 11. Since the walls of transfer pipe 11 contact the heat-sensitive sealing lips 12 of exhaust channel 8, it is desirable to cool the exhaust gas stream as much as possible. Although diluted in this manner, the constant flow of these gases through transfer pipe 11 tends to heat this portion of the exhaust ducting strongly. Thus, to provide heat insulation for sealing lips 12 of exhaust channel 8, transfer pipe 11 is designed to be double-walled. The interspace formed by the double wall either carries a flow of ambient air or is filled with insulating materials.

Vertical vehicle movements are allowed for by an adequate extension of transfer pipe 11 into exhaust channel 8. Transfer pipe 11 has sufficient vertical length for this purpose. To compensate for lateral motions of vehicle 1, relative to exhaust channel 8, transfer pipe 11 is pivotably attached. A conventional exhaust gas duct system employs an open collecting funnel extending from the transfer pipe cross section. The funnel is not connected to the ends of exhaust conduit 6 and protective pipe 7, but rather covers them without contact. Thus, it is possible under certain operating conditions for exhaust gases to be blown into the surroundings.

Two embodiments of connecting elements which are gas-tight, but yet permit pivoting motions, are illustrated in FIGS. 1–3 and 4–5, respectively. In both embodiments, transfer pipe 11, with its boat-shaped cross section seen in horizontal section between the break lines, is of a double-walled design with interposed, vertical spacers 20. In the embodiment shown in FIGS. 1–3, transfer pipe 11 is connected to a pleated metal bellows 10 having a circular cross section. The transition from the boat-shaped cross-section to the circular cross-section is accomplished by way of transition member 22 which is interposed between pipe 11 and bellows 10. The other end of bellows 10 is connected to the end of protective pipe 7 which is also provided with encircling cuff 23 for centering exhaust conduit 6. Conical pipe section 24 covers the annular gap between an outside marginal bead of cuff 23 and the roof surface. Conical pipe section 24, as well as cuff 23 and bellows 10, are clamped around the circumference of protective pipe 7 by clamping strap 25. The other end of bellows 10 is similarly connected by clamping strap 26 to transition member 22. Transfer pipe 11 and transition member 22 are further supported by mounting flanges 27 attached to roof 9 on both sides of bellows 10. Mounting flanges 27 have hinged joints 28 which extend parallel to the longitudinal vehicle axis at a level approximately aligned with the middle of bellows 10. Joints 28 thus define the axis about which transfer pipe 11 pivots.

Figure 3:
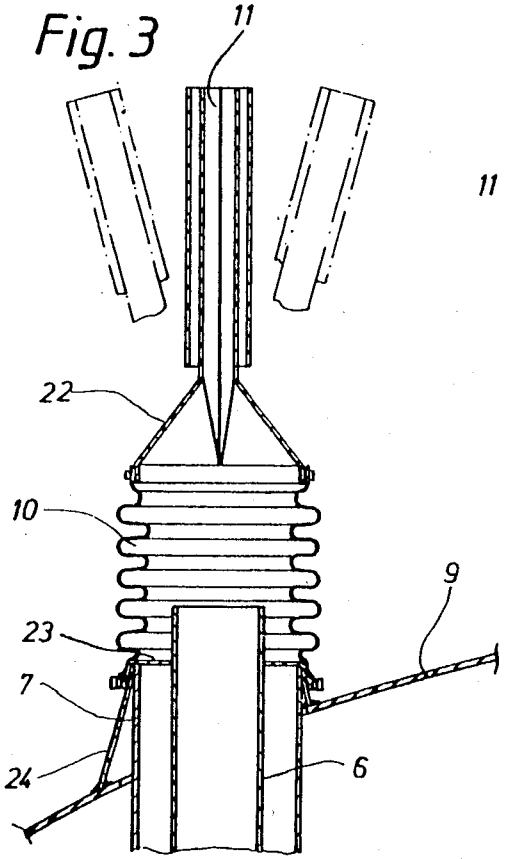
FIG. 3 shows a section along line III—III of the exhaust duct system shown in FIG. 2.
Figure 4:
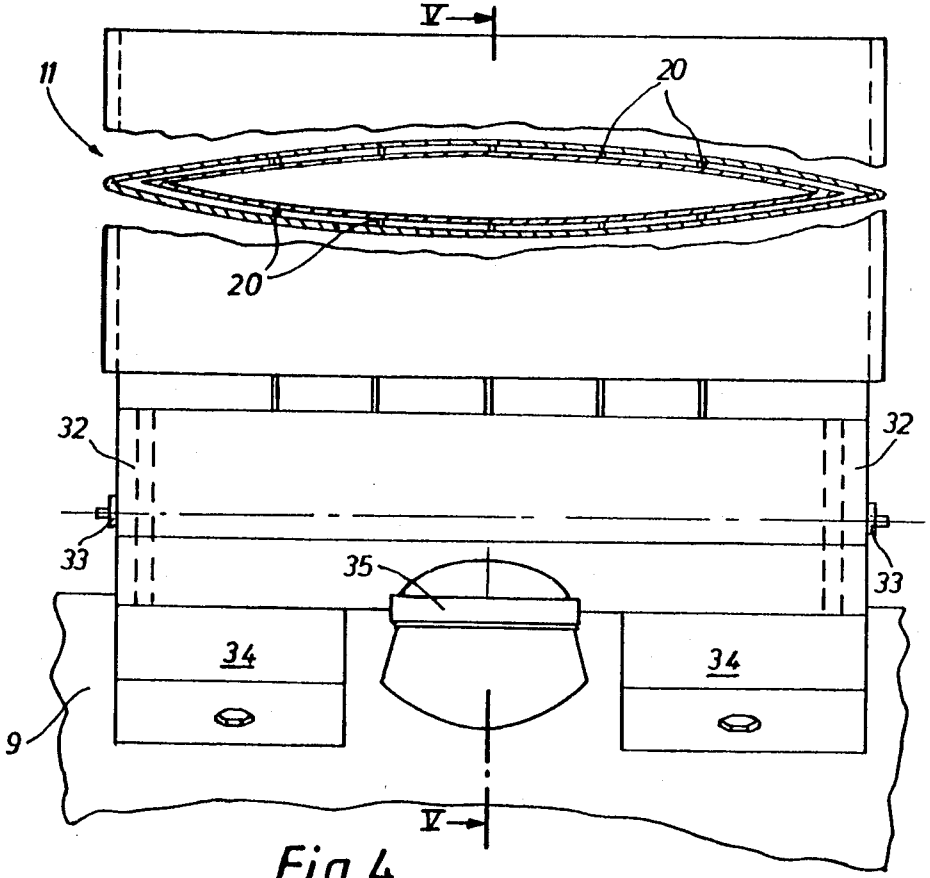
FIG. 4 shows, in accordance with the present invention, a lateral view of the exhaust duct system with pipe shells used as the connecting element.
Figure 5:
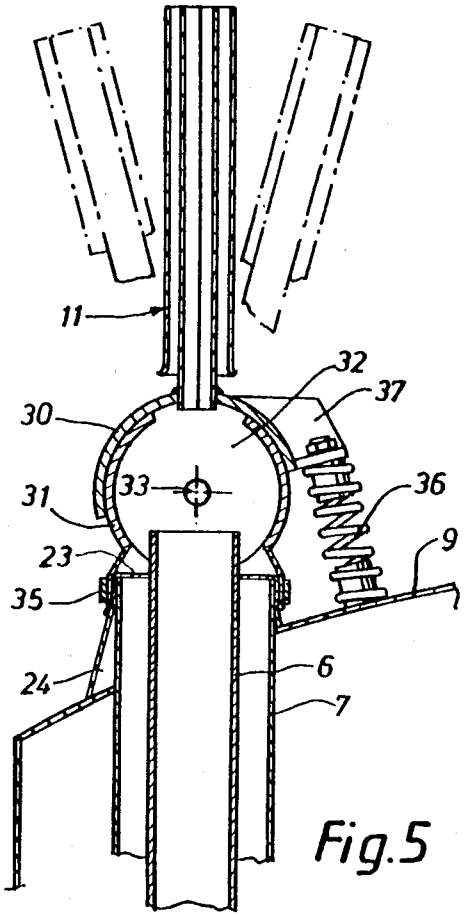
FIG. 5 shows a section along line V—V of the exhaust duct system shown in FIG. 4.

FIGS. 4 and 5 show in views, corresponding to FIGS. 2 and 3, another embodiment. The connecting element between exhaust conduit 6 and protective pipe 7, on the one hand, and transfer pipe 11, on the other hand, are two pipe shells 30, 31, which, together with cover plates 32, form a cavity. Cover plates 32 have pivot bearings 33 which define the pivot axis of transfer pipe 11. Pipe shell 31 is fixed and is connected to roof 9 by mounting flanges 34. Shell 31 has, as viewed from above, a circular opening in its outer surface area, with a connecting stub joined to protective pipe 7. Both parts are held together by clamping strap 35 which, as in the embodiment shown in FIGS. 2 and 3, also clamps cuff 23 for centering exhaust conduit 6 and conical pipe section 24 which covers the annular gap between roof 9 and protective pipe 7. A slot-like, longitudinally extending opening is located in the top of pipe shell 31.

Pipe shell 30, which is pivotable about the pivot axis and slides along the shell surface of fixed pipe shell 31, has a semicircular cross section which covers and seals the slot-like opening in pipe shell 31 in all permitted pivotal positions. Circular cover disks 32 at the end faces of over-lapping pipe shells 30 and 31 provide for a concentric connection of pipe shells 30 and 31 by pivot bearings 33. An upwardly pointing, boat-shaped opening in outer pipe shell 30 provides for the connection of transfer pipe 11 which, together with pipe shell 30, is pivotable about the axis of pivot bearings 33.

The length of pipe shells 30 and 31 is approximately equal to the length of the boat-like cross section of transfer pipe 11. Righting spring 36 maintains transfer pipe 11 in a vertical position as shown by solid lines in FIG. 5. Righting spring 36 is, on one end, connected to bracket 37 which is connected to pipe shell 30. The other end is attached to roof 9 of vehicle 1.

Both embodiments of the connecting elements connect protective pipe 7 and exhaust conduit 6 to transfer pipe 11 so as to seal the exhaust gas flow from the surroundings. Accordingly, exhaust gases cannot escape during operation of vehicle 1. The connecting elements are laterally movable about the pivot axis such that the elements remain gas-tight when driving through a route which calls for transverse movements of the vehicle. FIGS. 3 and 5 show, in dot-dash lines, various pivotal positions of transfer pipe 11.

Elastic pleated metal bellows, or righting spring 36 as used with pipe shells 30 and 31, provide automatic rebounding for maintaining transfer pipe 11 in a vertical position for driving on routes not equipped with exhaust gas disposal systems and for facilitating the entry of transfer pipe 11 into exhaust channel 8.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed is:

1. An exhaust duct system for a track-guided vehicle powered by an internal combustion engine, said duct system extending vertically above a roof of said vehicle into a force-vented exhaust channel located adjacent to a driving route of said vehicle, said duct system comprising:

an exhaust conduit;

a protective pipe surrounding said exhaust conduit and terminating a short distance above said roof;

a transfer pipe extending into said channel, said pipe having a boat-shaped horizontal cross-section; said transfer pipe being biased toward a vertical position; and connecting means for connecting said exhaust conduit and said protective pipe to said transfer pipe, said connecting means forming a substantially gas-tight connection and said connecting means being pivotable about an axis extending substantially parallel to a longitudinal axis of said vehicle, wherein said connecting means comprises elastic pleated metal bellows, said bellows acting to bias said transfer pipe toward a vertical position.

* * * * *